US010821624B2

(12) United States Patent
Pieper et al.

(10) Patent No.: US 10,821,624 B2
(45) Date of Patent: Nov. 3, 2020

(54) PUNCHING OR STAMPING MACHINE AND SHEET PROCESSING METHOD

(71) Applicant: KAMA GMBH, Dresden (DE)

(72) Inventors: Steffen Pieper, Dresden (DE); Jan Gockel, Radebeul (DE); Raik Freudenberg, Dresden (DE)

(73) Assignee: KAMA GMBH, Dresden (DE)

( * ) Notice: Subject to any disclaimer, the term of this patent is extended or adjusted under 35 U.S.C. 154(b) by 56 days.

(21) Appl. No.: 16/130,518

(22) Filed: Sep. 13, 2018

(65) Prior Publication Data

US 2019/0099911 A1 Apr. 4, 2019

(30) Foreign Application Priority Data

Oct. 2, 2017 (EP) ..... 17194373

(51) Int. Cl.

| | |
|---|---|
| ***B26F 1/40*** | (2006.01) |
| ***B65H 5/08*** | (2006.01) |
| ***B31B 50/04*** | (2017.01) |
| ***B65H 5/10*** | (2006.01) |
| ***B31B 50/14*** | (2017.01) |

(52) U.S. Cl.

CPC ..... *B26F 1/40* (2013.01); *B31B 50/04* (2017.08); *B31B 50/142* (2017.08); *B65H 5/10* (2013.01); *B31F 2201/0702* (2013.01); *B65H 2405/55* (2013.01); *B65H 2701/176* (2013.01); *B65H 2801/42* (2013.01)

(58) Field of Classification Search

CPC ..... B26F 1/40; B31B 50/04; B31B 50/142; B31F 2201/0702; B65H 2405/55; B65H 2701/176; B65H 2801/42; B65H 5/10

See application file for complete search history.

(56) References Cited

U.S. PATENT DOCUMENTS

| | | | | |
|---|---|---|---|---|
| 4,078,956 A * | 3/1978 | Scheck | ..... | B26F 1/40 156/157 |
| 6,152,441 A * | 11/2000 | Vossen | ..... | B65H 29/02 271/3.17 |
| 2008/0092705 A1* | 4/2008 | Imkamp | ..... | B26F 1/40 83/155 |

(Continued)

FOREIGN PATENT DOCUMENTS

| | | |
|---|---|---|
| DE | 1045778 B | 12/1958 |
| EP | 1466851 A2 | 10/2004 |

OTHER PUBLICATIONS

Machine translation of EP 1466851 (Year: 2004).*

*Primary Examiner* — Stephen Choi
(74) *Attorney, Agent, or Firm* — Heslin Rothenberg Farley and Mesiti PC; Nicholas Mesiti

(57) ABSTRACT

In a sheet processing method for sheets of paper or cardboard, a sheet for processing is, in the processing station, firstly brought to a standstill and then set down, whereas the processed sheet is, in the output station, set down from a moving state. A punching or stamping machine has an input station, a processing station and an output station arranged one behind the other in a sheet transport path, and a sheet gripping device which is designed to set down a sheet for processing in the processing station when the sheet gripping device has come to a standstill in a second reversal position, and to set down a processed sheet in the output station as the sheet gripping device approaches the second reversal position.

3 Claims, 2 Drawing Sheets

(56) References Cited

U.S. PATENT DOCUMENTS

2011/0072764 A1* 3/2011 Daniek ..... B29C 66/8221
53/556
2015/0241875 A1* 8/2015 Ehrbar ..... G05B 19/41865
700/122

* cited by examiner

PUNCHING OR STAMPING MACHINE AND SHEET PROCESSING METHOD

CROSS-REFERENCE TO RELATED APPLICATION

The present U.S. patent application claims priority to European patent application number 17194373.1 filed on Oct. 2, 2017, which is hereby incorporated by reference herein in its entirety.

BACKGROUND ART

The invention relates to improvements to and further developments of punching or stamping machines and to sheet processing methods that can be carried out by means of such punching or stamping machines.

A punching or stamping machine is to be understood to mean a device for punching sheet-like material, composed in particular of paper or cardboard, having at least an input station, in which sheets for processing are provided, a processing region, in which the sheets for processing are processed by interaction of a punching or stamping tool and a counterpart plate, and an output station, in which processed sheets are set down, wherein, by means of a sheet transport device, the sheets are moved individually and in stepwise fashion in series from the input station to the processing station, are subjected in the processing station to the action of the punching or stamping tool, and are subsequently moved from the processing station to the output station.

EP 1 466 851 A2 describes, in paragraph [0003], a known punching machine in which a continuous gripper clamp, which runs at least via two working positions to the side of the movement path of the punched sheets, laterally grips two punched sheets and transports these jointly to the respectively next working position, wherein then, the gripper clamp returns to the initial position after setting down the punched sheets. Because the gripper clamp grips and holds both sheets simultaneously, it is also only possible for both sheets to be set down simultaneously. With such an arrangement, an already-processed sheet can be set down correctly in the output station only if the sheets are set down there on a stationary underlying surface, for example are stacked one on top of the other. This makes it necessary for the sheets to subsequently be individually removed from the output station again, for example in order for punchings that are cut out of the sheet as a result of the punching process to be broken away and separated from the waste. This gives rise to a considerable time delay.

Taking this prior art as a starting point, it is the intention to specify an improved sheet processing method and an improved punching or stamping machine, with which more uniform and faster further processing of the sheets is made possible.

BRIEF SUMMARY OF THE INVENTION

Said object is achieved, in terms of a method, by means of a sheet processing method having the features of claim 1 and, in terms of a device, by means of a punching or stamping machine having the features of claim 6. The dependent claims relate to advantageous embodiments and refinements.

Therefore, there is firstly proposed a sheet processing method for sheets of paper, cardboard, plastic or the like, in which sheet processing method an input station for the provision of sheets for processing, a processing station for processing a sheet arranged therein, and an output station for the setting-down of processed sheets are provided one behind the other in a sheet transport path, and, repeatedly in series,

- in the input station, a sheet for processing, and in the processing station, an already-processed sheet, are gripped,
- the sheet for processing is moved from the input station into the processing station and is set down, and the processed sheet is moved from the processing station into the output station and is set down, and
- the sheet for processing is processed in the processing station, wherein
- the sheet for processing is, in the processing station, firstly brought to a standstill and then set down, whereas
- the processed sheet is, in the output station, set down from a moving state.

By contrast to the previously known solutions, the proposed method makes it possible for the two sheets to be set down independently of one another, whereby an acceleration of the entire method sequence is made possible in particular by virtue of the fact that, in the output station, a conveyor which operates continuously with a conveying speed is provided for the onward transport of a sheet, onto which conveyor the processed sheet is set down. It is now no longer necessary for the already-processed, that is to say punched and/or stamped, sheets, in the output station, to be accelerated from a standstill, or pulled separately from a stack, in order for the punchings to be broken away and separated from the waste; rather, it is possible for the sheets to be transported onward without interruption directly to a breakaway station arranged so as to follow the output station in the sheet transport path, wherein slippage of the sheet on the conveyor is prevented by virtue of the sheet being set down on the conveyor from a moving state, whereby a significant increase in productivity can be achieved.

Here, provision may particularly advantageously be made for the sheet for processing and the processed sheet to be moved with a transport speed which, at least during the setting-down, that is to say at the moment of the setting-down, of the processed sheet in the output station, at least approximately corresponds to the conveying speed of the conveyor, because, the smaller the relative speed between the conveyor and the processed sheet set down thereon at the moment of the setting-down, the less tendency there is for the processed sheet to slip on the conveyor.

The risk of undesired slippage of the sheet set down on the conveyor can be furthermore inhibited by virtue of the processed sheet being held on the conveyor by generation of an air pressure difference between a top side and a bottom side of the sheet, for example by virtue of a negative pressure being generated at the bottom side of the sheet, such that the sheet is pressed onto the conveyor by the surrounding air pressure. Provision may alternatively or additionally be made for the processed sheet to be held on the conveyor by the generation of at least one force which acts on a top side of the sheet, for example by a hold-down means which is held above the conveyor with a spacing which corresponds to the thickness of the transported sheet.

To carry out the method, there is also proposed a punching or stamping machine which comprises

- an input station, a processing station and an output station arranged one behind the other in a sheet transport path, and
- a sheet transport device which is designed for gripping, moving and setting down two sheets, which sheet transport device has at least one linear guide arranged parallel to the sheet transport path and has a sheet gripping device which is movable back and forth along the linear guide between a first reversal position and a second reversal position, wherein, in the first reversal position, the sheet gripping device is positioned in the input station and in the processing station in order to grip in each case one sheet, and in the second reversal position, the sheet gripping device is positioned in the processing station and in the output station in order to set down in each case one sheet, wherein the sheet gripping device is designed to set down a sheet in the processing station when the sheet gripping device has come to a standstill in the second reversal position, and to set down a sheet in the output station as the sheet gripping device approaches the second reversal position.

The proposed punching or stamping machine furthermore makes allowance for the fact that the sheet for processing must be set down highly accurately in the processing station, which is realized by virtue of the fact that the sheet gripping device releases the sheet only when said sheet gripping device has come to a standstill at the second reversal point.

By contrast, the already-processed sheet that has been removed from the processing station is released by the sheet gripping device already while in motion, whereby seamless onward transport is made possible. This onward transport may be realized for example by means of a second sheet gripping device arranged downstream of the processing station, which second sheet gripping device takes on the sheet from the first sheet gripping device while said first sheet gripping device is still in motion.

The sheet gripping device may for example have at least two gripping elements which are controllable separately from one another, such that one of the gripping elements releases the sheet for processing after the sheet gripping device has come to a standstill in the processing station, and the other gripping element releases the processed sheet from a moving state already before the second reversal position is reached. Gripping elements in this context may for example be gripping clamps, suction-type grippers etc.

For example, the sheet gripping device may have a common base rail with which the at least two gripping elements interact in order to either jointly or independently of one another grip in each case one sheet and subsequently either jointly or independently of one another set down in each case one sheet. In the example of the prior art as discussed in EP 1 466 851 A2, it would thus be possible for the upper rail, which is movable back and forth relative to the lower rail between a closed position, in which the two sheets are fixedly clamped, and an open position, in which the two sheets are released, to be divided into two partial rails which are separately activatable in order to be able to individually grip and/or release the respective sheet.

As already described above, the onward transport of the processed sheet from the output station may be realized for example by means of a second sheet gripping device arranged downstream of the processing station. Alternatively, and particularly advantageously, provision may however also be made for a conveyor which operates continuously with a conveying speed and which serves for the onward transport of a sheet to be arranged in the output station. Such a conveyor may for example be a roller-type conveyor which comprises a multiplicity of transport rollers arranged transversely with respect to the transport direction, which transport rollers are arranged one behind the other in a horizontal plane and the uppermost casing lines of which transport rollers define a transport plane for the processed sheets. Said conveyor may alternatively be a belt-type conveyor which has an areal transport belt or one or more relatively narrow transport belts which are guided around at least two diverting rollers or diverting rolls and the upper strand of which in each case defines the transport plane of the sheets.

Provision is advantageously made for the sheet gripping device to move between the first reversal position and the second reversal position with a transport speed which, at least during the setting down of the processed sheet in the output station, at least approximately corresponds to the conveying speed of the conveyor, as has already been discussed in more detail above with reference to the proposed method.

Provision may furthermore advantageously be made for the conveyor to be designed to generate a negative pressure at the bottom side of the sheet. This may for example be realized by virtue of the conveyor being a belt-type conveyor with a perforated belt and with a suction box arranged under said belt. Alternatively, or in addition, above the conveyor, there may be arranged at least one pressure-exerting means, for example one or more pressure-exerting rolls, which act(s) on a top side of the sheet.

Finally, in the case of the proposed punching or stamping machine, provision may be made for the at least two gripping elements to be operatively connected to a jointly acting actuating device for gripping the respective sheet and to separately acting actuating devices for setting down the respective sheet. In this way, it is ensured in a simple manner that both gripping elements, in the first reversal position, simultaneously grip the two sheets, whereby the pausing of the sheet gripping device in said position can be limited to the shortest duration possible. By contrast, at the end of the movement process from the first to the second reversal position, the two sheets can be released at different points in time. Thus, the already-processed sheet can be set down in the output station from a moving state, whereas the sheet that is still to be processed is set down in the processing station only after the sheet-gripping device has come to a standstill.

BRIEF DESCRIPTION OF THE DRAWINGS

The invention will be discussed in more detail below on the basis of an exemplary embodiment and associated drawings, in which.

DETAILED DESCRIPTION

Figure 1:
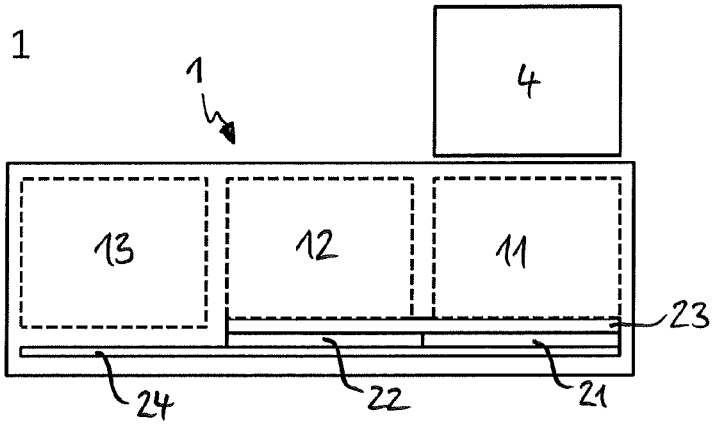
FIGS. 1 to 8 show different method steps on a punching or stamping machine.

The punching or stamping machine 1 illustrated in FIGS. 1 to 8 comprises a discontinuously operating input station 11, a discontinuously operating processing station 12, and a continuously operating output station 13. Laterally adjacent to the input station, the processing station and the output station, and thus parallel to a sheet transport path along which sheets are moved through the punching or stamping machine, there extends a sheet transport device which is designed for gripping, moving and releasing two sheets, which sheet transport device has a linear guide arranged parallel to a sheet transport path and has a sheet gripping device, which sheet gripping device is movable back and forth along the linear guide between a first reversal position and a second reversal position and has a common base rail, which in the exemplary embodiment is the lower rail, and two separately activatable gripping elements, which in the exemplary embodiment are partial rails of the upper rail, which gripping elements interact with the common base rail in order to grip in each case one sheet at a lateral edge.

Laterally adjacent to the punching or stamping machine 1 in the region of the input station 11, there is arranged a sheet stack 4 by means of which the sheets for processing are provided to the machine and fed individually to the input station 11.

In FIG. 1, the sheet gripping device is arranged in a first reversal position, in which a first gripping element 21 for gripping a sheet for processing 31 is positioned in the input station 11 and a second gripping element 22 for gripping a processed sheet 32 is positioned in the processing station 12. Those gripping elements 21, 22 are open and are thus ready to grip a respective sheet 31, 32.

Figure 2:
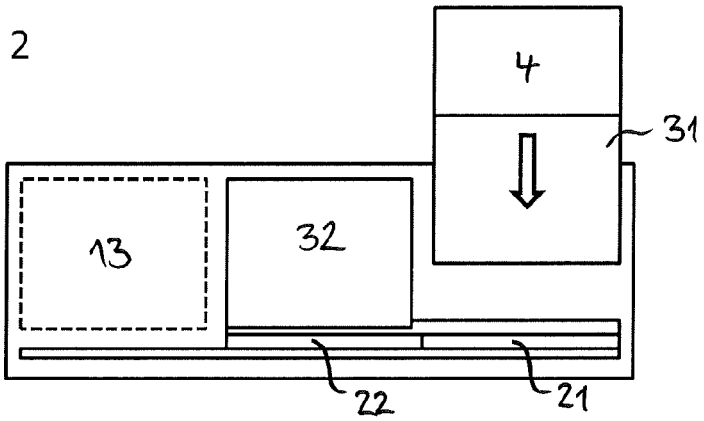
Figure 3:
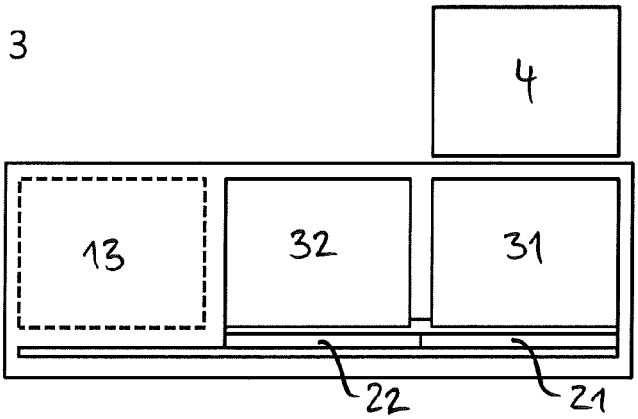

FIG. 2 shows how a sheet for processing 31 is removed from the sheet stack 4 and moved transversely with respect to the sheet transport path into the input station 11, whereas, in the processing station 12, an already-processed, that is to say stamped or punched, sheet 32 is situated such that it can be gripped by the second gripping element 22. In FIG. 3, the sheet for processing 31 has also come to a standstill in the input station 11, such that it can be gripped by the first gripping element 21.

Figure 4:
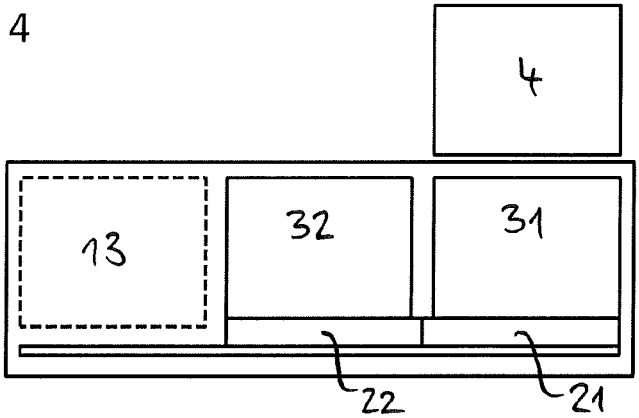

FIG. 4 shows how the first gripping element 21 grips the sheet for processing 31 lying in the input station 11, and the second gripping element 22 grips the processed sheet 32 lying in the processing station 12. The gripping occurs simultaneously by virtue of both gripping elements 21, 22 being simultaneously closed by means of a common actuating device, such that both sheets 31, 32 are gripped at a lateral edge, that is to say an edge running parallel to the sheet transport path.

Figure 5:
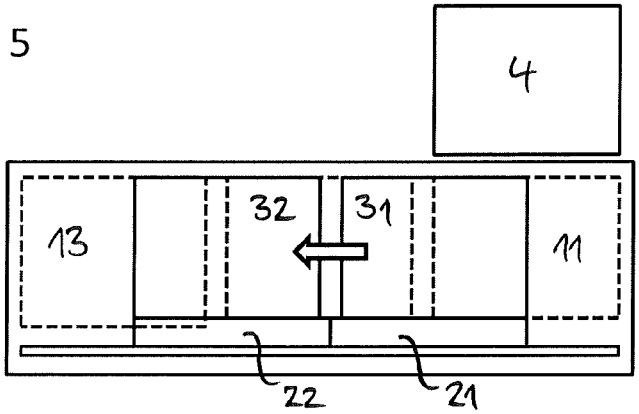
Figure 6:
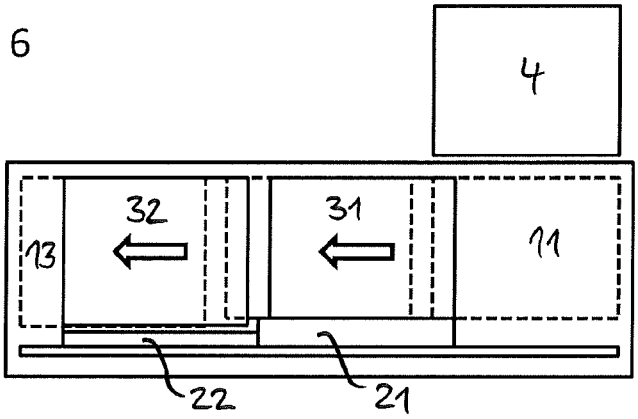

FIG. 5 shows how the sheet gripping device is, with the closed gripping elements 21, 22 and with the two sheets 31, 32, moved from the first reversal position in the direction of the second reversal position. FIG. 6 illustrates how the second gripping element 22 is opened by means of a separate actuating device and sets down the processed sheet 32 on a continuous conveyor arranged in the output station 13, which conveyor moves at the same speed as the sheet gripping device as the sheet gripping device approaches the second reversal position, that is to say already before the second reversal position is reached. From this point in time onward, only the sheet for processing 31 is moved by the first gripping element 21 of the sheet gripping device, whereas the processed sheet 32 is moved onward by the continuous conveyor.

Figure 7:
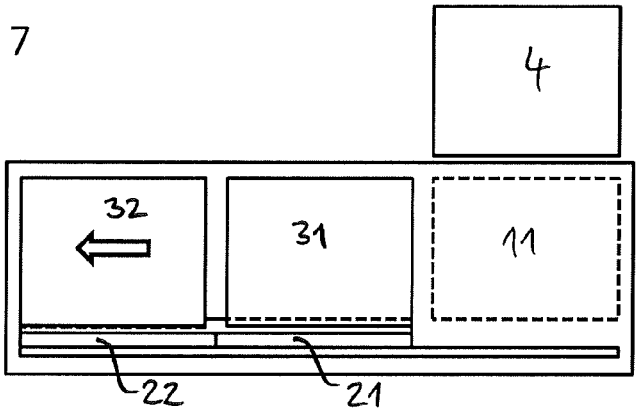

FIG. 7 shows the moment at which the sheet gripping device reaches the second reversal position and comes to a standstill there. The first gripping element 21 sets down the sheet for processing 31 in the processing station 12 by virtue of the first gripping element 21 being opened by means of a separate actuating device. Both gripping elements 21, 22 are now open, and the processed sheet 32 is moved onward by the continuous conveyor arranged in the output station 13.

Figure 8:
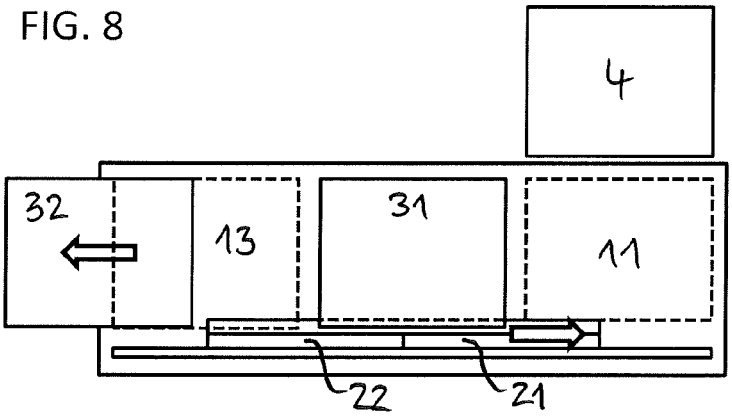

As shown in FIG. 8, the processed sheet 32 exits the punching or stamping machine 1 on the conveyor, for example in order to be fed to a breakaway station, while the sheet gripping device with the two gripping elements 21, 22 is moved back into the first reversal position and the sheet for processing 31 is processed, that is to say punched or stamped, in the processing station 12. The described steps are subsequently repeated again.

What is claimed is:

1. A sheet processing method for sheets of paper, cardboard, plastic or the like, the processing method including an input station for the provision of sheets for processing, a processing station for processing a sheet arranged therein, and an output station for the setting-down of processed sheets which are provided one behind the other in a sheet transport path, and a sheet transport device movable between a first reversal position and a second reversal position along a sheet transport path and, repeatedly in series, gripping in the input station, a sheet for processing, gripping in the processing station, a processed sheet, moving the sheet for processing from the input station into the processing station and releasing said sheet for processing, moving the processed sheet from the processing station into the output station substantially simultaneously with the moving of the sheet for processing and releasing the processed sheet, and processing the sheet for processing in the processing station, wherein the sheet for processing is, in the processing station, firstly brought to a stop and then released, and the processed sheet is, in the output station, released while still moving, wherein release of the processed sheet occurs before release of the sheet for processing.

2. The sheet processing method as claimed in claim 1, in which, in the output station, a conveyor which operates continuously at a conveying speed facilitating the onward transport of a sheet, wherein the processed sheet is released onto the conveyor.

3. The sheet processing method as claimed in claim 2, in which the sheet for processing and the processed sheet are moved at a transport speed which, at least during the releasing of the processed sheet in the output station, is substantially equal to the conveying speed of the conveyor.

* * * * *